United States Patent [19]

Clement

[11] Patent Number: 4,540,182

[45] Date of Patent: Sep. 10, 1985

[54] POWER OPERATED TARGETS FOR SHOOTING RANGES

[76] Inventor: Tommy G. Clement, 1012 Florence Rd., Savannah, Tenn. 38372

[21] Appl. No.: 477,869

[22] Filed: Mar. 23, 1983

[51] Int. Cl.[3] ..... F41J 7/04

[52] U.S. Cl. ..... 273/392; 273/406

[58] Field of Search ..... 273/390, 391, 392, 374, 273/375, 127 D, 404, 410; 73/167

[56] References Cited

U.S. PATENT DOCUMENTS

| | | | |
|---|---|---|---|
| 809,796 | 1/1906 | Grabosch . | |
| 910,608 | 1/1909 | Thompson et al. . | |
| 1,087,507 | 2/1914 | Palen . | |
| 1,523,747 | 1/1925 | Bradley | 273/375 |
| 1,865,988 | 7/1932 | Wiedeck . | |
| 2,284,510 | 5/1942 | Cates . | |
| 2,561,733 | 7/1951 | Foyst . | |
| 2,805,066 | 9/1957 | Mongello . | |
| 3,194,066 | 7/1965 | Schwab et al. . | |
| 3,248,110 | 4/1966 | Webb | 273/53 X |
| 3,319,960 | 5/1967 | Wilcox | 273/404 |
| 3,392,980 | 7/1968 | Ortega . | |
| 3,511,506 | 5/1970 | Schollick . | |
| 3,515,388 | 6/1970 | Zachmeier . | |
| 4,119,317 | 10/1978 | Ohlund et al. . | |
| 4,239,234 | 12/1980 | Ward | 273/391 |
| 4,260,156 | 4/1981 | Momura . | |
| 4,426,085 | 1/1984 | Dixon | 273/392 |

FOREIGN PATENT DOCUMENTS

| | | | |
|---|---|---|---|
| 443659 | 10/1927 | Fed. Rep. of Germany | 273/392 |
| 693501 | 7/1940 | Fed. Rep. of Germany | 273/391 |

*Primary Examiner*—Anton O. Oechsle

*Attorney, Agent, or Firm*—Browdy and Neimark

[57] ABSTRACT

A target apparatus using heavy silhouette targets has a power operated resetting mechanism. Resetting may be activated by a falling target, after being hit, striking a switch. A reset spring can be fully loaded by the weight of the falling target to aid in resetting the target which may also be counterweighted. Targets may be reset individually, or a series of targets reset simultaneously after the last target is hit, or all hit targets may be reset automatically after a preselected number of targets have been hit, or resetting can occur after a time delay, to provide various resetting pattens. A bottle of compressed air or a battery enables self-contained target apparatuses to be provided.

13 Claims, 17 Drawing Figures

FIG. 1
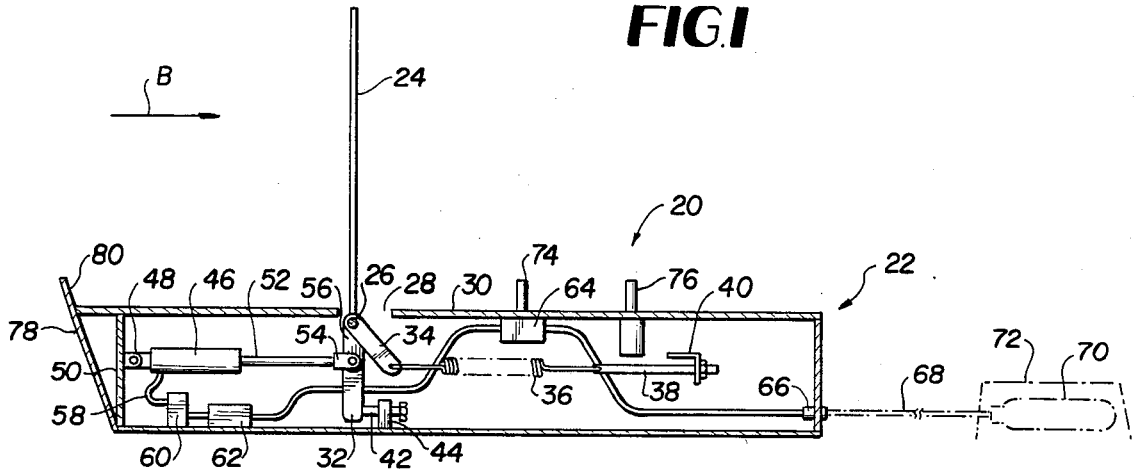
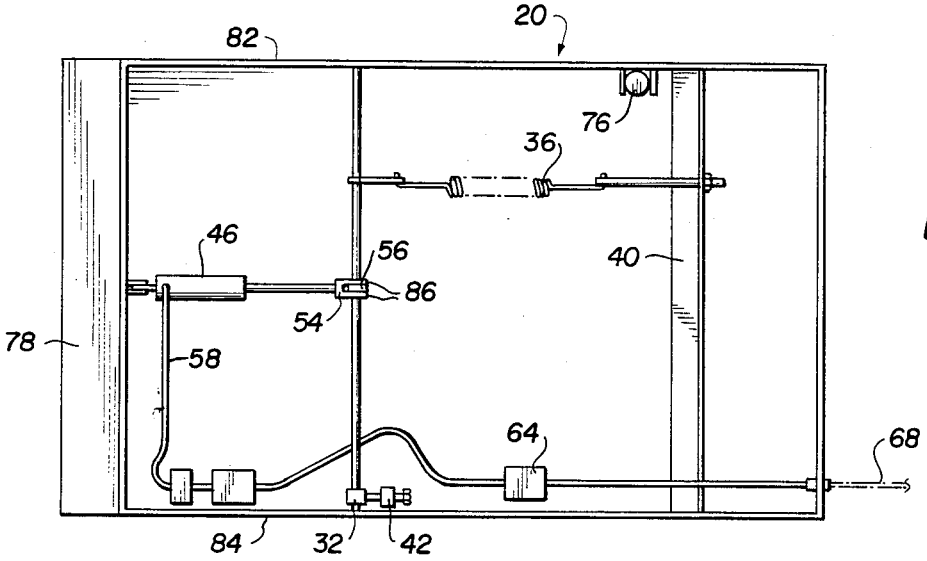
FIG. 2
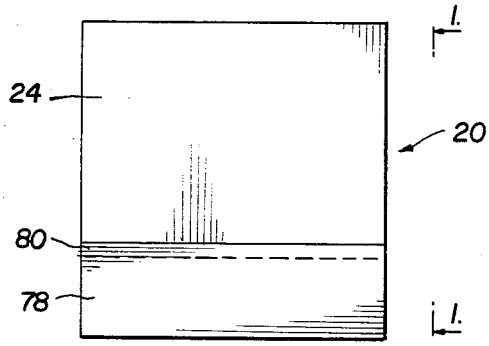
FIG. 3
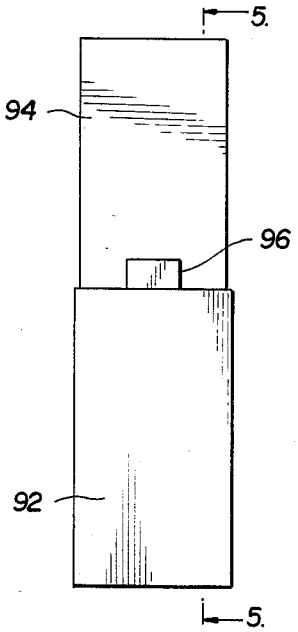
FIG. 4

FIG.5
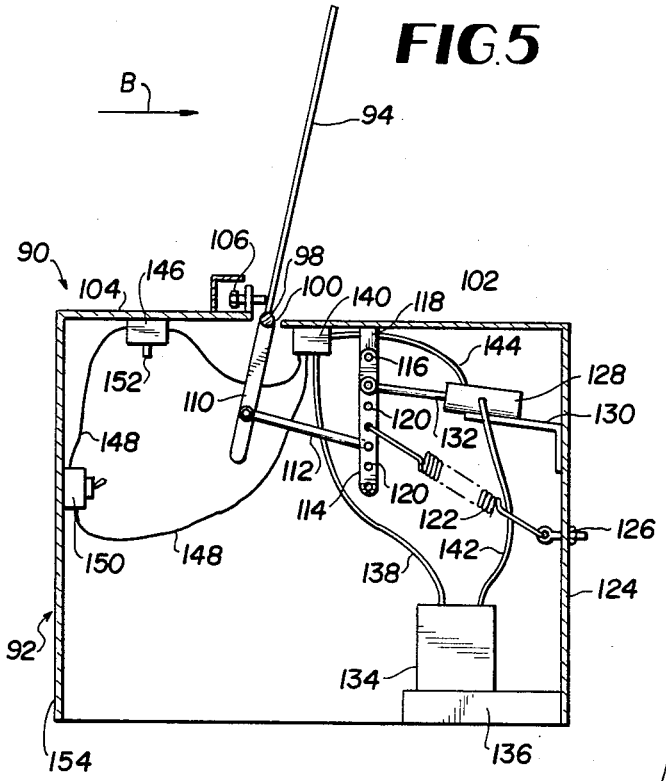
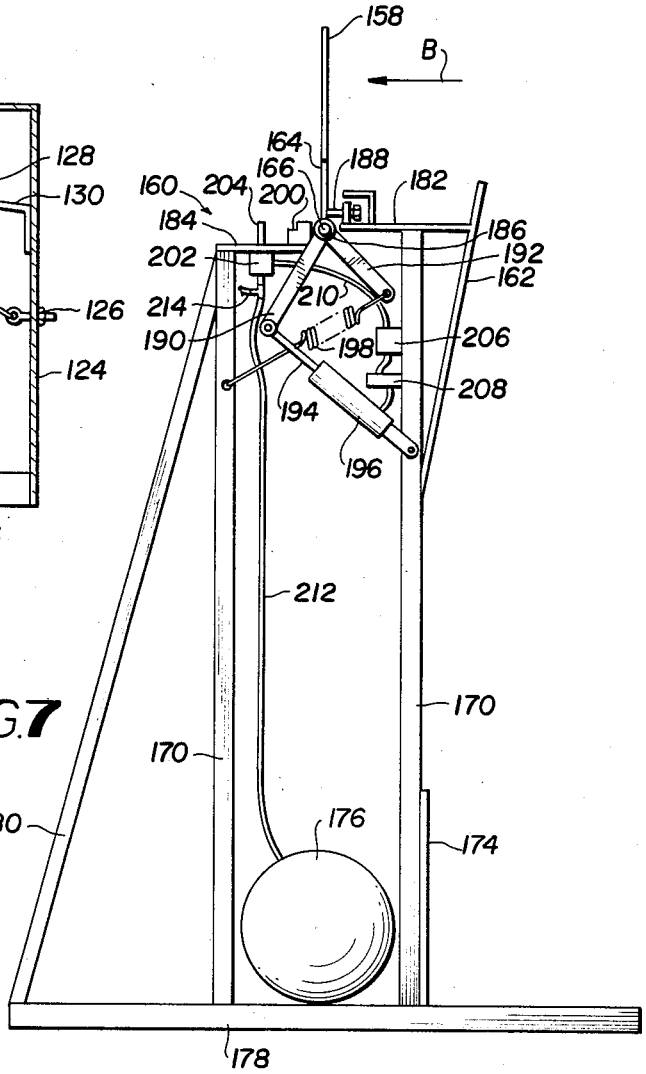
FIG.7
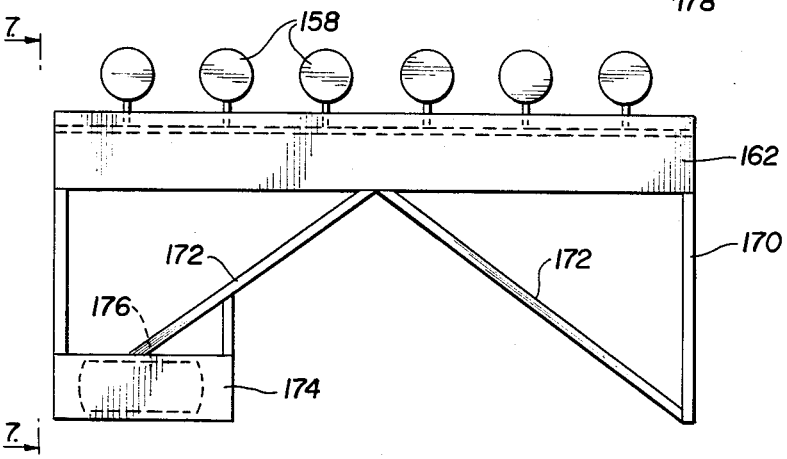
FIG.6

POWER OPERATED TARGETS FOR SHOOTING RANGES

FIELD OF THE INVENTION

This invention relates to power operated target apparatus for practice or competition on shooting ranges or the like, and particularly to the resetting of targets that fall when hit by bullets or the like, and to the operation of targets that rotate about vertical axes.

BACKGROUND OF THE INVENTION

It is known to have targets, such as silhouette targets, that fall from a vertical upstanding position to a horizontal down position when hit by a bullet. To reset the targets to the upstanding position, various mechanisms have been proposed such as manually operated levers or pull rods, remotely operated pull cords or chains, and power operated mechanisms manually activated.

It is also known to have targets that rotate through 90 degrees about vertical axes from a full view position, in which the target is presented to the marksman, to a concealed position in which only the thin edge of the target faces the marksman.

It has been common practice to use cardboard targets that require frequent replacement, particularly when using bull's eye type targets that require checking of the bullet holes therein to calculate the score of the marksman. It has been proposed to use metal targets that do not require such frequent replacement. However, a problem with metal targets is the power needed to reset them due to their weight.

For safety reasons, as well as for convenience and to save time, it would be desirable to be able to reset or operate targets while at a location remote from the targets and out of the line of fire of the marksmen shooting at the targets.

SUMMARY OF THE INVENTION

It is one of the objects of the present invention to provide a target apparatus in which a target is automatically reset after having been knocked down by a bullet or the like.

A feature by which this is achieved in the provision of an activator switch which is actuated by the falling of the target to activate a power operated mechanism which resets the target.

Another object of the invention is to decrease the power consumption needed to reset a fallen target, particularly a heavy metal target.

A feature by which this object is achieved is the provision of a spring which is fully loaded by the weight of the target as it falls and provides stored power for aiding the resetting of the target throughout the resetting thereof. This has the advantage of reducing the power consumed by the power operated resetting mechanism. A further feature by which power consumption is reduced is the cutting off of power from the power operated resetting mechanism before resetting is completed and providing for the spring to complete the resetting. In this arrangement an "over center" position is created on one side of which the weight of the target predominates and will cause it to fall, and on the other side of which the bias of the spring predominates and returns the target to the upstanding position.

Yet another object of the present invention is to provide a target apparatus in which the target remains down after it is hit yet is still automatically reset.

This object is achieved by having a timing device associated with the activator switch whereby the resetting mechanism is only activated after a predetermined time delay. This has the advantage of reinforcing the visual observance that the target has been hit. It also has the further advantage that when only a specific time is allocated for shooting at a number of targets, all targets hit can be arranged to stay down until the allocated time has expired and thereafter be automatically reset.

A further object of the present invention is the provision of a self-contained automatically operated target apparatus. A feature by which this is achieved is the provision of a compressed air container and an air cylinder both housed in the target apparatus. Another feature by which this is achieved is the provision of a battery and a solenoid or motor housed in the target apparatus.

Another object of the present invention is to keep the area around the target apparatus tidier. A feature to achieve this is the provision of a forwardly and upwardly inclined guard plate at the front of the target apparatus that directs low bullets downwardly onto the ground in front of the target apparatus. A further feature is the extension of this guard plate above the top surface of the target apparatus to provide a tray for collecting bullets deflected downwardly and forwardly off the target. Both these features also have the advantage of enabling the deflected bullets to later be collected for recycling, particularly in the case of lead bullets.

Yet another object of the invention concerns the vertically rotated disappearing type of target, and is to preset the target in the full view position for a limited time only. This is achieved by incorporating in the target apparatus a timing device which activates a power operated mechanism for rotating the target out of sight after a preselected time.

Another feature of one aspect of the present invention is the incorporation of two solenoids when employing a battery as the self-contained power source, and providing a lost motion linkage arrangement whereby one only of the solenoids starts the resetting operation and the other completes it. This has the advantages that more compact solenoids can be employed, and also the drain on the battery is reduced.

With another embodiment of the present invention, a feature is a common reset mechanism for a target apparatus having a plurality of targets, and an activator switch which is operated by the hitting of one particular target only to simultaneously reset that target and all previously hit targets. This has the advantage that the last target to be shot in a sequence of targets can be associated with the activator switch so that no targets are reset until the last target has been hit.

In another embodiment of the invention, a feature is the employing of a lost motion linkage with an electric motor to reset the target.

Other objects, features and advantages of the present invention will become more fully apparent from the following detailed description of the preferred embodiments, the accompanying drawings and the appended claims.

BRIEF DESCRIPTION OF THE DRAWINGS

In the accompanying drawings:

FIG. 1 is a side view in the direction of the arrows 1—1 in FIG. 3 of a target apparatus according to the invention with a side wall removed, and illustrating a separately located compressed air source;

FIG. 2 is a bottom view of the apparatus of FIG. 1;

FIG. 3 is a front view of the apparatus of FIG. 1;

FIG. 4 is a front view of another embodiment of the invention;

FIG. 5 is a section on the line 5—5 of FIG. 4;

FIG. 6 is a front view of yet another embodiment of the invention having six targets and a self-contained supply of compressed air;

FIG. 7 is a diagrammatic side view in the direction of the arrows 7—7 of FIG. 6 with a side plate omitted and the position of some parts distorted for clarity;

DETAILED DESCRIPTION OF THE PREFERRED EMBODIMENTS

Figure 8:
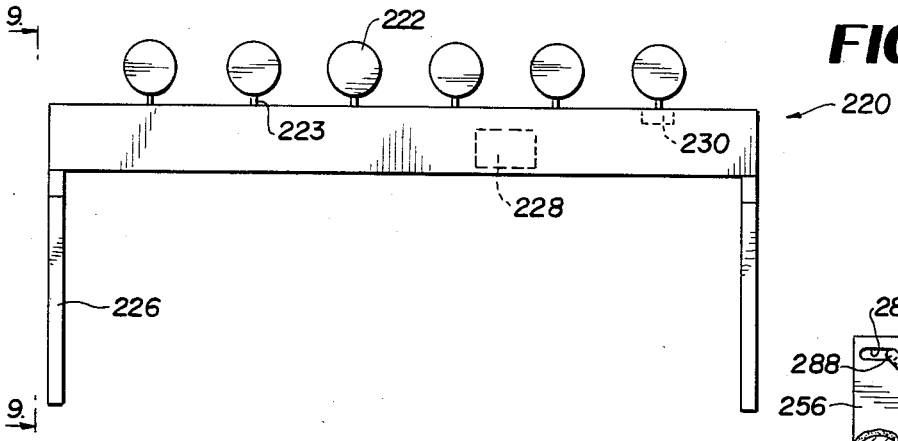
FIG. 8 is a front view of a further embodiment of the invention having a plurality of targets and a self-contained battery power source.

The preferred embodiment of the invention is shown in FIGS. 1, 2 and 3, although features of other embodiments shown in subsequent Figs. may advantageously be incorporated into the preferred embodiment as will be described later.

FIG. 1 shows in side view, with the near side wall omitted, an automatically operating target apparatus 20 having a base housing 22 from which upstands a heavy metal target 24. Bullets strike the forward face of the target 24 in the direction of the arrow B. The target 24 is attached, for example by welding, at its lower edge to a shaft 26 the ends of which are pivotally mounted in bores in the two side walls of the base housing 22. The target 24 extends upwardly through a slot 28 in the top 30 of the housing 22. A counterweight 32 is securely attached to the shaft 26 and extends downwardly in the housing 22 in line with the plane of the target 24. A downwardly and rearwardly extending lever 34 is rigidly secured to the shaft 26 at its upper end and has a coil spring 36 connected to its free end. The spring 36 is adjustably attached by a threaded bolt 38 to an angle iron 40 which extends between and is secured to the side walls of the housing 22. An adjustable stop bolt 42, screw threaded through a side wall bracket 44, cooperates with the counterweight 32 to determine the exact upstanding position of the metal target 24, in which position it is resiliently retained by the spring 36 which is under tension.

An air cylinder 46 is pivotally connected at 48 to a front wall 50. The piston rod 52 of the air cylinder 46 is pivotally connected by means of a yoke 54 to a short lever 56 secured to and extending downwardly and rearwardly from the shaft 26. Angularly, the short lever 56 extends between the lever 34 and the counterweight 32. An air line 58 extends from the air cylinder 46 to an air pressure regulator 60, then to a pneumatically operated timer 62, an air switch 64 and is finally connected via a detachable connector 66 to a compressed air supply line 68. The supply line 68 extends from a source of compressed air 70, preferably a compressed air bottle or rechargeable pressure tank housed in a framed protective housing 72. The source of compressed air 70, framing 72 and supply line 68 are shown in broken lines as they may be disposed in different ways as will be described later. The air switch 64 is mounted in the housing top 30 with an actuating member 74 extending upwardly for actuation by the target 24. A shock absorber 76 also extends upwardly through the top 30 for cushioning the fall of the target 24. The shock absorber 76 may be of any suitable type for a heavy mass, such as pneumatic, a heavy compression spring or a combination of both.

The extreme front wall 78 of the housing 22 is inclined upwardly and forwardly and extends a short distance above the top 30 to form a lip 80. The lip 80 helps retain spent bullets on the top 30 in front of the target 24 if they rebound downwardly after striking the target 24. The forwardly inclined front 78 deflects downwardly to the ground below any mis-aimed low bullets that strike the front 78 instead of the target 24. Both these features aid in keeping the target area more tidy from spent bullets and in enabling such bullets to be collected for recycling purposes.

FIG. 2 shows the open underside of the target apparatus 20. The ends of the shaft 26 are journalled in the side walls 82, 84 with the air cylinder 46 connected to the center of the shaft 26. The forks 86 of the piston rod yoke 54 can be seen straddling the short lever 56. The spring 36 is located to one side of the air cylinder 46 and the counterweight 32 is located on the other side at one end of the shaft 26 adjacent side wall 84. The shock absorber 76 is mounted on side wall 82 and the air switch 64 is located adjacent side wall 84.

FIG. 3 shows the front of the target apparatus 20 as seen by the marksman. The metal target is shown as rectangular, but any other type or shape of silhouette target can be employed, such as the popular animal silhouettes.

Although the target apparatus 10 is fairly heavy, the base housing 22 being made of $\frac{3}{8}$ inch plate steel and 3/16 inch angle iron, and the target 24 being of $\frac{3}{8}$ inch plate and weighing between 50 and 75 pounds, nevertheless the apparatus 10 is fairly portable and can conveniently be repositioned or relocated. The target apparatus 10 can be placed directly on the ground or above the ground on a frame. In the latter case, two or more targets can be combined on the same frame. This frame can be the framed housing 72 containing the air supply 70 so making the apparatus completely self-contained. Alternatively, the air supply 70 can be separately located and connected to a plurality of target apparatuses 20 positioned at different locations.

In operation the target is held upright by the spring 36 acting on the lever 34. When a bullet, travelling in the direction B, strikes the front of the metal target 24, the impact causes the target 24 to pivot backwards from its upright position to a lowered position in which it is substantially horizontal overlying the rear of the housing top 30. This pivoting movement of the target 24 as it falls further tensions, i.e. loads, the spring 36. This loading of the spring 36 reduces the impact with which the target 24 falls, and the final impact is taken by the shock absorber 76 which eliminates, or substantially reduces, any tendency of the falling target to bounce on the housing top 30. As the target 24 comes to rest on the shock absorber 76, it depresses the actuating member 74 and opens the switch 64 to supply compressed air from the source 70 to the air cylinder 46 via the timer 62 and pressure regulator 60. Actuation of the air cylinder 46 extends the piston rod 52 and, via the short lever 56, rotates the shaft 26 anti-clockwise (FIG. 1) to commence raising the target 24, the now highly energy loaded spring 36 aiding in this operation and so reducing the power required from the air cylinder 46. As the target rises, it releases the actuating member 74 which in turn causes the air switch to close and cut off further supply of compressed air to the air cylinder 46. However, the pushing force provided by the expanding air already in the cylinder 46, together with the action of the spring 36, is sufficient to continue to raise the target 24. Before the target reaches its upstanding position, substantially in a vertical plane, the air cylinder 46 exhausts to atmosphere and the spring 36 completes the return movement of the target 24 and resiliently maintains the target in its upstanding position until struck by another bullet. The timer 62 is adjustably set to create a time delay in connecting the compressed air from the switch 64 to the regulator 60. This time can be set for a few seconds to reinforce visual observation that the target 24 had fallen, or may be set for a longer time so that any one of a plurality, for example six, targets being fired at in sequence by a competitor and hit, will remain down until the time allotted to the competitor has elapsed. The regulator 60 ensures that the air delivered to the cylinder 46 is at the correct pressure regardless of the supply being at a higher, possibly variable, pressure.

The adjusting bolt 38 for the spring 36 and the adjustable stop bolt 42 for determining the upstanding position of the target 24, which may be caused to lean back from or forward of a vertical plane, are adjusted to accommodate different target weights and the magnitude of bullet impact to topple them.

It should be noted that not only is the falling of the target 24 used to load the spring 35, but the spring and the effective weight of the target create a type of "overcenter" effect whereby the target is maintained in a stable upright position by the spring and in a stable fallen position by its own weight. However, part way between the upright position and the fallen position is an equilibrium position in which the moment of the target's effective weight about the axis of the shaft 26 equals an opposite direction moment of the force of the spring about that axis. From this equilibrium position the spring 36, although contracting, is capable by itself of returning the target to its upstanding position of FIG. 1, so effecting a further reduction in power required to raise the target.

The weight of the counterweight can also be chosen to further reduce the power required. By having the counterweight shorter in length than the target 24, and by making the counterweight heavy, the position of the equilibrium position can be moved further towards the fallen position. This arrangement further reduces the distance through which the air cylinder 46 has to raise the target and the power required from the air cylinder, so reducing the consumption of compressed air. Compressed air consumption can be optimized by making the counterweight heavier than the target; this is due to the falling moment of the target not exceeding the restoring moment of the counterweight until the target has reached a predetermined acute angle to the horizontal.

Thus, not only is a self-contained automatically operating target provided, but one that will operate from a single air bottle for several hours, for example 3 or 4 hours, of target shooting.

FIGS. 4 and 5 illustrate another embodiment of the invention, with FIG. 4 showing in front view, as seen by the marksman, an automatically operated target apparatus 90 having a housing 92 pivotally supporting an elongated rectangular target 94. As before, the housing 92 is constructed of heavy steel plate and angle irons, and the target is of $\frac{3}{8}$ inch steel plate weighing over 50 pounds. The main body of the target is detachably secured to a smaller base plate 96 so that different shaped and size targets can be used with the target apparatus. The housing 92 forms a support structure.

FIG. 5 shows the shaft 98 to which the base plate 96 is rigidly secured, the shaft being journalled at its ends in the side walls of the housing 92. The target 94 extends upwardly through a slot 100 in the top of the housing, the rear portion 102 of the top being at a slightly lower level than the forward portion 104. An adjustable stop 106 is mounted on the forward top portion 104 to adjustably determine the inclination of the target 94 in the upstanding position as shown in FIG. 5. An angle shaped guard 108 protects the stop 106 from bullets. The base plate 96 has a lever-like extension 110 which extends past the shaft 98 into the housing 92. This lever-like extension 110 is pivotally attached to one end of a link 112, the other end of the link 112 being pivotally attached to an intermediate lever 114 which extends upwardly and is pivoted at its upper end at 116 to a bracket 118 depending from the rear top portion 102. The intermediate lever 114 has a series of apertures 120 along its length, and through one of these is connected an end of a spring 122, the other end of the spring being adjustably connected to the rear housing wall 124 by an adjustable anchoring bolt 126. A solenoid 128 is mounted on a strong bracket 130 welded to the rear wall 124, the actuating rod 132 of the solenoid being pivotally connected to the intermediate lever 114 above the link 112. A heavy duty battery 134 is supported on a flanged shelf 136. The positive lead 138 from the battery is connected to a relay actuated solenoid switch 140 mounted on the underside of the rear top portion 102. The negative lead 142 from the battery is connected to the solenoid 128, the latter being connected by a lead 144 to the solenoid switch 140. An activator switch 146 is securely mounted on the underside of the front top portion 104 and is connected by wires 148 in series with a safety on/off switch 150 to the relay circuit of the solenoid switch 140. The body of the activator switch may form a stop for the target 94 to be contacted by the free end of the lever-like extension 110 in the lowered position of the target 94, that is when the target has been knocked down by a bullet travelling in the direction of the arrow B. It should be noted that in the "down" position of the target, the stop formed by the activator switch 146 holds the target at an angle of about 25 degrees to the horizontal, i.e. in a partially raised position in such case.

In operation, the spring 122, which is a strong coil spring and initially under substantial tension, holds the target 94 stably in the upstanding position against the stop 106. When a bullet strikes the target 94, the impact overcomes the force of the spring 122 and the inertia of the target, and causes the target to pivot clockwise (FIG. 5) and fall until stopped by the body of the activator switch 146. The falling action of the target 94 further loads the spring 122 and so reduces the impact of the fall. An actuating member 152 protruding downwardly from the activator switch 146 is depressed by the fallen target and closes the activator switch so activating the solenoid switch 140 which causes the solenoid 128 to be energized. The solenoid, which is powerful and of heavy duty construction, pulls the intermediate lever 114 rearwardly with substantial force. This starts to raise the target 94 in conjunction with the highly tensioned spring 122, and then as the momentum of the target carries it through the balanced or equilibrium position (as defined in the previous embodiment), the spring 122 completes the return of the target 94 to the upstanding position. It should be noted that as the lever-like extension 110 leaves the activator switch 146, the actuating member 142 returns outwardly and opens the switch 146 with consequential opening of the solenoid switch 140 and deenergisation of the solenoid 128. However, due to the partially raised "down" position of the target 94, the strength of the spring 122, and the power of the solenoid 128, an initial powerful pull from the solenoid 128 is sufficient to raise the target past its "equilibrium" position.

The activator switch 146 or the solenoid switch 140 may be provided with a delay circuit so that there is a short delay, for example a second, after the activator switch 146 is opened, so delaying deenergisation of the solenoid 128 for the same delay period during the initial upward return of the target 94. The upward return of the target can further be adjusted, particularly for different targets, by adjusting the tension of the spring 122 by selecting the aperture 120 engaged and/or by means of the anchoring bolt 126. Further, an adjustable timing circuit may be incorporated in the activator switch 146 or the solenoid switch 140 for delaying for an adjustable period the energisation of the solenoid 128 after closing of the activator switch 146 by the target depressing the actuating member 152. As with the previous embodiment, this delay may be for a few seconds or a longer period related to the time a marksman has to shoot at the target or a series of targets.

Also, a shock absorber may be provided to cushion the fall of the target, and the front wall 154 of the housing 92 may be inclined upwardly and forwardly and provide a used-bullet retaining lip at the top. The self-contained automatic target 90 could be further modified by replacing the battery 134 and solenoid 128 by a compressed air bottle and air cylinder, respectively.

FIGS. 6 and 7 illustrate a further embodiment of the invention in which six smaller bull's-eye targets 158 are automatically controlled in a self-contained automatic target apparatus 160.

FIG. 6 shows a front view of the target apparatus 160 with the six metal targets 158, formed as circular discs of 8 inch diameter, equally spaced across and extending above the top of a front guard plate 162. Each target 157 has a downwardly extending stem 164 which is pivotally mounted on a common support shaft 166 which extends across the full width of the apparatus 160. The guard plate 162 forms the front of a housing 168 which is supported above the ground on a framework having end frame members 170 and cross brace members 172. At the lefthand lower corner of the framework, a metal shield 174 protects an air tank 176.

FIG. 7 diagrammatically illustrates a side view of the target apparatus 160 taken in the direction of the arrows 7—7 in FIG. 6, end cover plates and some other parts being omitted to more clearly show the working mechanism. Bullets strike the targets 158 in the direction of the arrow B. Each end frame has two vertical frame members 170 connected at the bottom by a base member 178 which extends both forwardly and rearwardly of the members 170 and the structure supported thereby. A forwardly inclined rear brace 180 extends upwardly from the rear end of each base member 178. The top of the mechanism housing has a forward top portion 182 which is at a higher level than a rear top portion 184 with a gap between the two portions 182, 184. The front guard plate 162 is inclined upwardly and forwardly to deflect low bullets onto the ground. The upper portion of the guard plate 162 extends above the forward top portion 182 for both protection and to form a tray to collect bullets. The stem 164 of each target 158 has a boss 186 at its lower end which is rotatably mounted on the fixed common shaft 166 so that each target 158 can pivot independently about the shaft 166. An adjustable stop 188 determines the extent of forward movement of the target 158. Each boss 186 has secured thereto and downwardly depending therefrom two levers 190, 192 in the form of a bell crank. The rear lever 190 is pivotally connected to the piston rod 194 of an air cylinder 196 which is pivotally attached forwardly in the housing 168. A coil spring 198 is tensioned between the forward lever 192 and a rear frame member to yieldably urge the target 158 against the stop 188 and maintain the target in its upstanding position. A stepped rubber shock absorber 200 is supported on the rear top portion 184 to cushion impact of a target 158 when knocked down by a bullet. An air switch 202, having an upwardly extending actuating member 204, is mounted on the underside of the rear top portion 184 just behind the shock absorber 200. A pneumatially operated timer 206 and an air pressure regulator 208 are mounted on the front frame member 170. The switch 202, the timer 206, the regulator 208 and the air cylinder 196 are connected in series by an air line 210. The switch 202 is connected to the rechargeable air tank 176 by a main air line 212. Just below the switch 202, a branch air line 214 from the main air line 212 supplies the air switches and air cylinders associated with the other five targets 158.

In operation, when a bullet travelling in the direction B strikes the target 158, the impact causes the target 158 to pivot rearwardly and fall against the shock absorber 200. Some of the energy dissipated by the target 158 in falling is transferred to the spring 198 which becomes elongated and highly tensioned. Upon falling, the target 158 depresses the actuating member 204 and opens the air switch 202, this in turn supplying compressed air to the air cylinder via the timer 206 and regulator 208 to cause the piston rod 194 to be drawn into the air cylinder 196 and raise the target 158, the spring 198 completing the movement of the target 158 to its upright position against the stop 188. During the movement of the target 158, the lever 190 pivots through approximately 90 degrees so that the air cylinder 196 passes through an over-center position with respect to the shaft 166, and so with respect to the pivotal axis of the target 158. The air cylinder 196 is provided with a return spring and a relief valve. The air cylinder 196 only operates to raise the target 158 through about the first 30 degrees of its upward pivotal movement. At that point the air cylinder is angularly directly in line with the shaft 166 and the piston rod 194 has reached the limit of its movement into the air cylinder 196; at this point the relief valve vents the air cylinder to atmosphere and the air cylinder's return spring starts returning the piston rod 194 outwardly. It will be appreciated that immediately the air cylinder commences to raise the target 158, the actuator member 204 returns upward so closing the air switch 202 and cutting off further supply of compressed air to the air cylinder 196.

In this way compressed air is economised with the air cylinder 196 only providing the initial power to start raising the target 158 and then the stored energy in the spring 198 completing the resetting of the target.

The air timer 206 for each target 158 is individually adjustable and effects a delay after closing of the respective air switch 202 before the associated air cylinder 196 is charged with compresed air under regulated pressure. This delay can be set as a few seconds or to allow sufficient time for a competitor to shoot at all six targets before any hit targets start to reset. Each target can be set with the same delay time, or the delay time can be set progressively less for each target as, for example, the targets are counted from the left to the right in FIG. 6. With this latter arrangement the sequence of shooting at the targets would be from left to right, all hit targets then resetting at approximately the same time after completion of shooting.

Another embodiment of the invention is illustrated in FIGS. 8 to 11, and is a self-contained automatically operated target apparatus 220 having a plurality of targets which are all automatically erected after the last target has been hit.

FIG. 8 shows in front view six circular targets 222 of ⅜ inch steel plate mounted in a row above a housing having a front guard plate 224. The target apparatus 220 is raised above the ground on end frames 226. All the operating parts of the apparatus are protected by the guard plate 224. The position of a battery 228 which powers the erecting of the targets is shown in broken lines. Similarly, the position of an activator switch 230, activated by the falling of the last target 222*a*, i.e. the target on the extreme right in FIG. 8, is also shown in broken lines. The targets 222 have downwardly extending tails 223 which are independently pivoted on a common fixed shaft extending from one end of the target apparatus 220 to the other.

Figure 9:
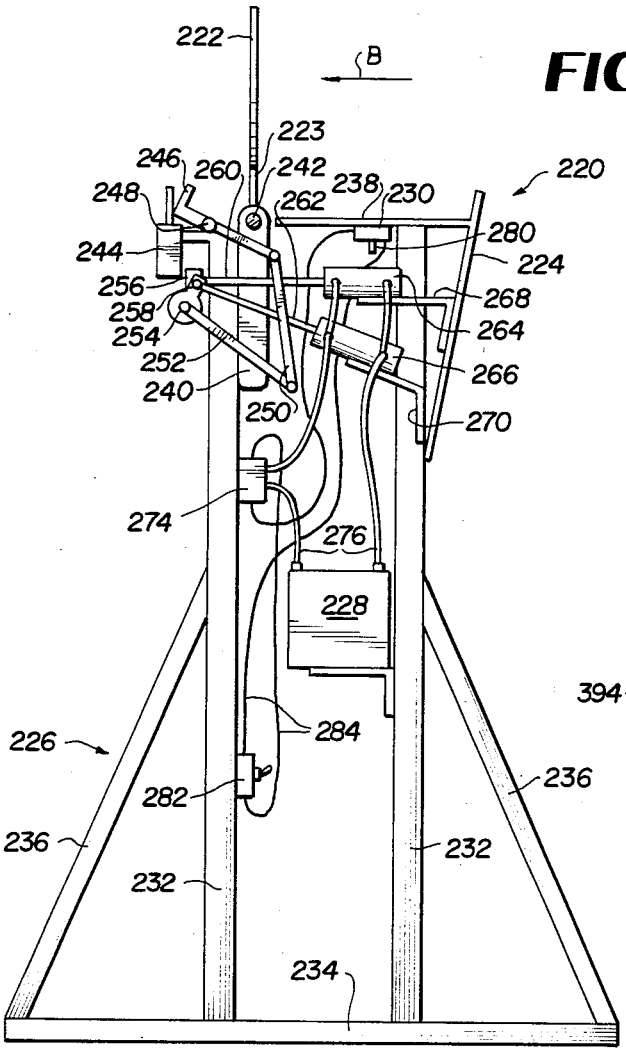
FIG. 9 is a diagrammatic side view of the line 9—9 of FIG. 8 with an end cover plate omitted and the position of some parts distorted for clarity.

FIG. 9 is a schematic end view of the target apparatus 220 with an end plate and other parts omitted for clarity. Also, the disposition of some of the parts have been moved, as will be indicated later, to schematically more clearly show their interconnection. The end frames 226 each have two vertical members 232 standing on an elongated base member 234 with inclined braces 236 extending upwardly and inwardly from the ends of the base member 234 to part way up the vertical members 232. The front guard plate 224 is again inclined outwardly to form a tapered deflector, the upper edge portion extending above the top plate 238 to form a tray for bullets downwardly deflected from the targets 222. Each target 222 has a counterweight 240 extending below the fixed shaft 242, about which they both pivot. A shock absorber 244 is positioned at the rear of the apparatus behind each target 222 to absorb the impact when the target is toppled by a bullet travelling in the direction B. Also adjacent the rear of each target 222 is a right angled reset bar 246 pivotally mounted at 248 at the rear of the top of the apparatus. A leg of the reset bar 246 extends past its pivot 248 and is pivotally connected to an intermediate link 250 which extends downwards and is in turn pivotally connected to an arm 252 rigidly connected to a rotatable shaft 254. The shaft 254 is journalled in support brackets mounted on the frame of the apparatus 220 and extends the length thereof. Thus the shaft 254 is common to all six sets of linkages 246, 250, 252 so that all six reset bars 246 will simultaneously pivot with rotation of the shaft 254. Midway along the length of the shaft 254 are two axially and angularly spaced apart arms 256, 258, each respectively connected to the actuating rods 260, 262 of two solenoids 264, 266. The solenoids 264, 266 are securely mounted on brackets 268, 270, respectively, welded to the framework of the apparatus. The solenoids 264, 266 are connected in parallel with the battery 272 via a relay operated solenoid switch 274 by cables 276. The activator switch 230, having a depressable activating member 280, is mounted on the underside of the top plate 238 and is connected via a safely on/off switch 282 by leads 284 across the relay circuit of the solenoid switch 274. The battery 228 is in fact located in a higher position than schematically shown in FIG. 9, that is behind the guard plate 224 as indicated in FIG. 8. Also, the solenoid switch 274 and the safety switch 282 are positioned higher at the level of the guard plate 224 so that none of the mechanical and electrical components of the automatic resetting mechanism are exposed to bullet fire.

Figure 10A:
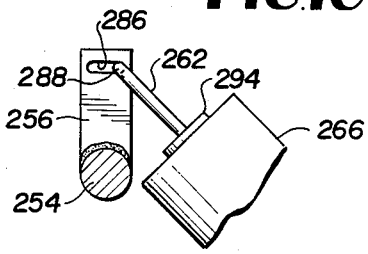
FIGS. 10*a* and 10*b* are separate enlarged illustrations of two details of the apparatus of FIG. 9.
Figure 10B:
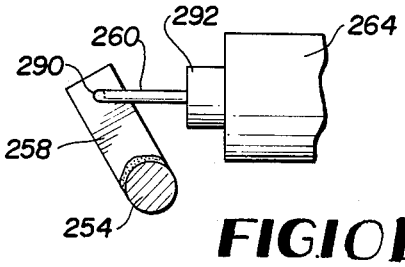

FIGS. 10*a* and 10*b* diagrammatically show on a larger scale the manner in which the solenoids 264, 266 are connected to the common reset shaft 254. The arms 256, 258 are welded to the shaft 254 and extend therefrom in the form of plates. The plate 256 has a transverse slot 286 in which slidably engages a cranked end 288 of the actuating rod 262 of the inclined solenoid 266. The end of the actuating rod 260 of the horizontal solenoid 264 is pivotally connected to the other plate 258 at 290. In operation, the inclined solenoid 266 draws the plate 256 a short distance to the right by the cranked end 288 drivingly engaging the right hand end of the slot 286. During this movement the shaft 254 is rotated, so rotating the other plate 258 the same amount and pushing the extended core 292 of the solenoid 264 therein via the actuating rod 260. At this point the core 294 of the solenoid 266 bottoms out and the core 292 of the other solenoid 264 becomes operational. The solenoid 264 now continues to rotate the shaft 254 by drawing the plate 258 a further distance to the right via the actuating rod 260; during this latter movement the plate 256 is also further rotated and, due to the core 294 having bottomed out, the cranked end 288 of the rod 262 slides along the slot 286 to the left hand end thereof.

Figure 11:
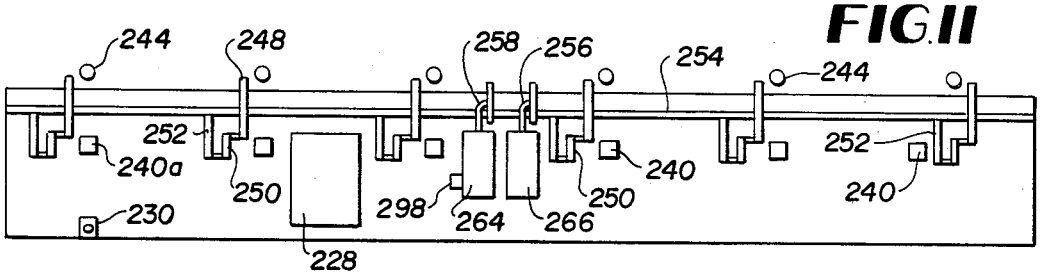
FIG. 11 is a diagrammatic underneath view of the embodiment of FIG. 8 with some parts omitted for clarity.

FIG. 11 is a diagrammatic underneath view illustrating the disposition of the six sets of reset linkage 248, 250, and 252 along the length of the reset shaft 254, together with the side-by-side relationship of the two solenoids 264 and 266, the shock absorbers 244, and the battery 228. Also shown are the six counter weights 240, and the single activator switch 230 opposite the counter-weight 240*a* of the sixth target 222*a*.

In operation, the impact of a bullet striking one of the targets 222 in the direction of the arrow B causes that target to fall backwards striking and coming to rest against its shock absorber 244 and the upper end of its reset bar 246. The target depresses the upper end of the reset bar 246 so pivoting it anti-clockwise (FIG. 9) and consequentially rotating the reset shaft 254 anti-clockwise via the lever 250 and arm 252. This rotates the plate arms 256, 258 so moving the actuating rods 260, 262 and pulling the cores 292, 294 outwards from their respective solenoids 264, 266. The core 292 is almost completely pulled out of the solenoid 264 to an extended position in which the solenoid 264 will not function. The core 294 is only partially withdrawn from the solenoid 266 to a position in which the solenoid 286 is still functional. When the activator switch 230 is tripped, as will be described later, it causes the solenoid switch 274 to close so connecting both the solenoids 264, 266 across the battery 272. This causes only the inclined solenoid 266 to function and rotate the reset shaft clockwise (FIG. 9) so starting to raise the target 222. After the target has been raised through about 45 degrees from its fallen position, the core 294 bottoms out and the solenoid 266 stops functioning. At that point, the core 292 of the horizontal solenoid 264 has been moved sufficiently into the range of the coil of that solenoid to enable the solenoid 264 to start functioning and raise the target 222 through the next 45 degrees to the upstanding position shown in FIG. 9. When the solenoid 264 has completed resetting of the target 222, both solenoids 264 and 268 are de-energised. This is preferably accomplished by a core position sensor 298 (see FIG. 11) mounted on the side of the solenoid 264, the sensor 298 being connected to the activator switch 230 to open the solenoid switch 274 when the core 292 reaches the predetermined position in which the target 222 is reset. However, this may be accomplished by incorporating a timing circuit in the activator switch which de-energises the solenoids 264, 268 a predetermined time after energisation, this time being calculated to be sufficient to raise the target 227 and momentarily hold it against a stop, for example a back member of the frame structure of the apparatus 220 could be engaged by the counterweight 240 to form such a stop. Further, the activator switch may include a time delay circuit for delaying for an adjustable period of time the energisation of the solenoids 264, 266 to reset the fallen target 222, such delay varying from a few seconds to a minute or more depending upon the purpose it is to serve.

As previously mentioned the activator switch 230 is positioned in front of the sixth target 222*a*. Its actuating member 280 is depressed by the counterweight 250 of the target 222*a* as that target completes its fall after being hit. When any of the targets 222 are knocked down by a bullet, the hit targets fall individually and stay in their fallen position. However, when and only when the end target 222*a* is knocked down, the switch 230 is actuated, the solenoids 264, 266 energised, the common reset bar 254 rotated, and the target 222*a* together with any other fallen targets 222 raised to their upstanding position. Consequently, the order of firing at the six targets 222 should be from left to right in FIG. 8. Only when the end target 222*a* on the right is hit and the switch 230 triggered will any and all previously hit targets be reset.

The arrangement of two solenoids 264 and 266 operating in sequence, enables smaller solenoids having a shorter stroke to be employed. For example, the pulling stroke of the solenoid 266 is only $\frac{3}{8}$ inch, and although the total travel of the actuating rod 260 of the other solenoid 264 is $\frac{7}{8}$ inch, only for about $\frac{1}{2}$ inch of this travel is the solenoid 264 actually pulling. The smaller solenoids are more compact and less expensive than a single heavy duty solenoid with sufficient power and stroke to reset the targets. Also, the two smaller sequentially operating solenoids are less of a drain on the battery 272 and conserve power.

Figure 12:
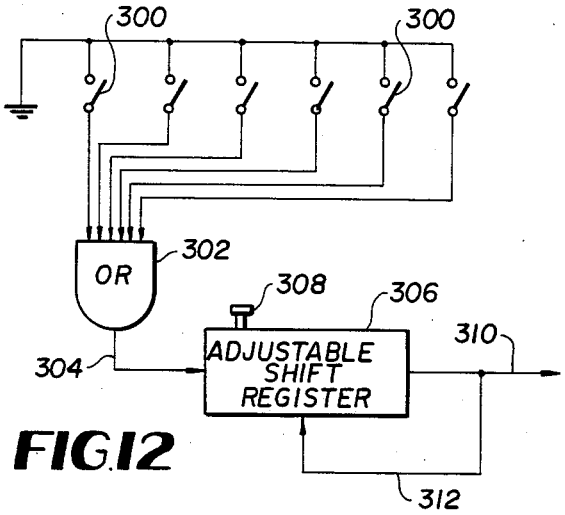
FIG. 12 is a schematic circuit diagram of a feature of the invention for resetting all hit targets after a preselected number have been hit.

FIG. 12 illustrates a modification applicable to all the previously described embodiments. It relates to a concept of enabling all targets hit to remain down until a predetermined number have been so hit, whereupon all hit targets are simultaneously reset. For example, with the target apparatus 220 of FIG. 8, when any four of the six targets 222 have been hit and knocked down, all four knocked down targets are reset simultaneously. With the embodiment of FIGS. 6 and 7, for example, when any three of the targets 158 of the apparatus 160 have been knocked down, the circuitry of FIG. 12 can be arranged to simultaneously erect the three knocked down targets. Further, any number of apparatuses 20 and 90 of the embodiments of FIGS. 1 to 3 and FIGS. 4 and 5, respectively, can be interconnected by the circuitry of FIG. 12 so that when a preselected number of the silhouette targets 24 and 94 have been knocked down, all hit targets are simultaneously raised.

FIG. 12 shows a schematic circuit diagram in which six target switches 300 are connected in parallel between ground and an OR gate 302. The output from the OR gate is fed via the lead 304 to an adjustable shift register 306 having a selector control knob 308. The output signal from the shift register 306 is fed via the lead 310 back to reset the targets. The output reset signal from the shift register 306 is also fed back into the shift register via the lead 312 for the purpose of resetting the register back to zero. The switches 300 are positioned to be individually actuated by the falling of individual targets. For example, each switch 300 can have a depressable actuating member and be positioned relative to a target to be actuated thereby when the target is hit by a bullet, such as the switch 76 in FIG. 1, the switch 146 in FIG. 5, the switch 202 in FIG. 7, or the switch 230 in FIG. 9. The reset signal from the shift register is used to activate the air cylinders or the solenoids of the fallen targets in the previously described embodiments to reset those targets. For example, the activator switches 76, 146, 202 and 230 could be arranged to have an additional pair of contacts which would be the switches 300, and the reset signal would activate the associated air valve or solenoid valve, if necessary through the intermediary of an amplifier and relay circuit. Preferably, this reset circuitry would be located in a multi-target apparatus, although it could be located in a separate control console and connected to a plurality of differently located target apparatuses.

In operation, the adjustable selector knob 308 is set to the number of targets that are to be hit before all the hit targets are simultaneously reset. When a target is hit and the associated target switch 300 closed, then a single impulse signal is fed to the OR gate 302 which feeds it to shift register 306 to register that signal. When the next target is hit, the closing of its associated target switch 300 transmits a second signal to shift register 301 and OR gate 302 which registers the second signal in addition to the first. This procedure continues regardless of the sequence in which the targets are hit, until the pre-set number of targets have been hit and an equivalent pre-set number of impulse signals have been registered. Then shift register 306 produces an output signal via the lead 310 to simultaneously actuate the activator means associated with the targets to reset all the hit targets. At the same time, the output signal on line 310 is also fed back via the lead 312 to reset the shift register to zero. With all the targets reset, the process can now be repeated.

The adjustable shift register 306 can be set by the selector 308 to operate for any number of hit targets from one to six, or larger number. Also, the OR gate can be connected to more than six targets and can function to reset the targets after any selected number of those to which it is connected have been hit.

Figure 13:
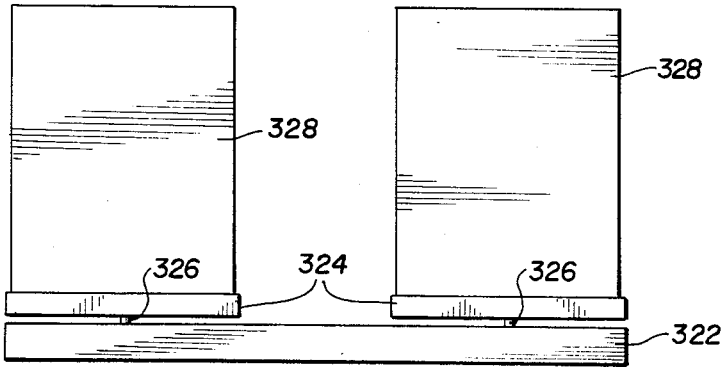
FIG. 13 is a front view of a target apparatus of the disappearing target type according to the invention and showing two targets in the full view position.
Figure 14:
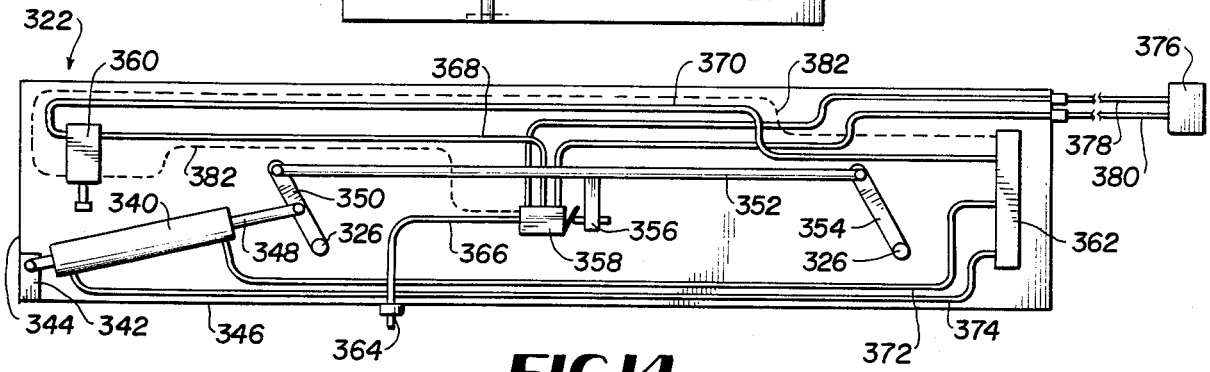
FIG. 14 is a bottom view of FIG. 13 with the bottom cover removed, and illustrates a remote control switch.

FIGS. 13 and 14 illustrate yet a further aspect of the present invention in improving the operation and resetting of targets. FIG. 13 shows a front view of an automatic target apparatus 320 having a base housing 322 supporting two metal holders 324 which are rotatable through 90 degrees on shafts 326 about vertical axes. Two cardboard or the like targets 328 are releasably held and supported by the holders 324. The targets 328, which can be of the silhouette type, are rotatable between two positions. A full view position as shown, and a concealed position at right angles to that shown and in which concealed position only the thin upright edge of the cardboard sheet is turned towards the marksman. FIG. 14 illustrates an underneath view of the housing 322 in which a double acting air cylinder 340 is pivoted at one end to a bracket 342 secured to adjacent walls 344, 346 of the housing. The piston rod 348 of the air cylinder is pivotally connected to an intermediate the length of an arm 350 rigidly secured at one end to the left hand target shaft 326. The free end of the arm 350 is pivotally connected to a link 352, the other end of the link 352 being pivotally connected to a corresponding arm 354 rigidly secured to the right hand target shaft 326. The link 352 carries an operating member 356 which cooperates with an activator switch 358 mounted on the underside of the top of the housing. Also mounted on the underside of the housing top are an air flow control valve 360 and an air timer 362. A connector 364 for a compressed air supply line is mounted in the housing wall 346. The compressed air supply can be a bottle or rechargeable container of compressed air and may be mounted in the apparatus 320 or at a remote location therefrom as shown and previously described for the automatic target apparatus 20, FIG. 1. The connector 364, air flow control valve 360, and air timer 362 are connected in series by air lines 366, 368, and 370, respectively. The air timer 362 is connected to opposite ends of the air cylinder 340 by air lines 372, 374. A remote control air switch 376 is connected by two lines 378, 380 across the activating switch 358 for remote control of the air flow therethrough.

In operation, the piston rod 348 is normally extended from the position shown in FIG. 14 and the targets 328 are turned through 90 degrees from the position shown in FIG. 13 so that the targets are in their concealed position. Upon actuation of the remote switch 376, compressed air is supplied from the source of supply to the air cylinder 340 via air lines 366, 378, 380, 368, 370 and 372. The piston rod 348 is then moved into the air cylinder 340 to the position shown in FIG. 14 with consequential rotation via the arms 350, 354 and link 352 of the targets 328 to the full view position shown in FIG. 13. At the completion of this rotation, the operating member engages the activator switch 358 which disconnects the air lines 378,380 and supplies compressed air directly from the line 366 to the line 368. This causes the air line 374 from the timer 362 to be activated so causing the piston rod to move outwardly and rotate the targets back to their concealed position where they remain until the remote switch 376 is again activated. The compressed air supply to the line 368 from the activator switch 358 is cut off as soon as the operating member 356 is moved out of contact with the switch 358. The timer 362 is adjustable to cause a time delay in connecting the air line 370 to the air line 374. This is used to keep the targets 328 in the full view position for a short period of time, for example 5 seconds. Thus, once the targets appear, the marksman has just, e.g., 5 seconds to shoot at them, then they automatically disappear. If desired, the same time delay can occur after actuating the remote control air switch 376 before the air cylinder 340 is activated to rotate the targets 328 into full view.

In a modification of target apparatus 320, the activator switch 358 can be a two way switch and connected by a second air line 382, shown in broken lines, to the timer 362 via the control valve 360. The remote switch 376 and the air lines 378, 380 are eliminated, and the timer is provided with two adjustable time settings. With this modification compressed air is always supplied to the timer 362, either via the lines 368, 370 when the operating member 356 is in contact with the valve 358, or via the line 382 when the operating member is out of contact with the valve 358. Then, when the lines 368, 370 are connected to the air supply, the targets rotate to their invisible position, this causing the line 382 to be connected to the air supply and automatically return the targets 328 to their full view position. This procedure repeats continually until the air supply of the apparatus 320 is shut off. The timer 362 imposes a time delay between each 90 degree rotation of the targets. For example, the time delay for connecting the line 370 to the air cylinder 340 could be 5 seconds, and the time delay for connecting the line 382 could be two minutes. Thus, the targets are invisible for 2 minutes, suddenly appear for 5 seconds and then disappear again for a further 2 minutes. With this arrangement, silhouette targets of $\frac{3}{8}$ inch steel plate can be used.

The target apparatus 320 can also be modified by incorporating part or all of the target moving mechanisms shown and described in relation to FIGS. 1, 2, 5, 7, 9, 10 and 11, with appropriate modification and with the rotational drive being turned from horizontal to vertical in order to twist the targets about vertical axes.

Figure 15:
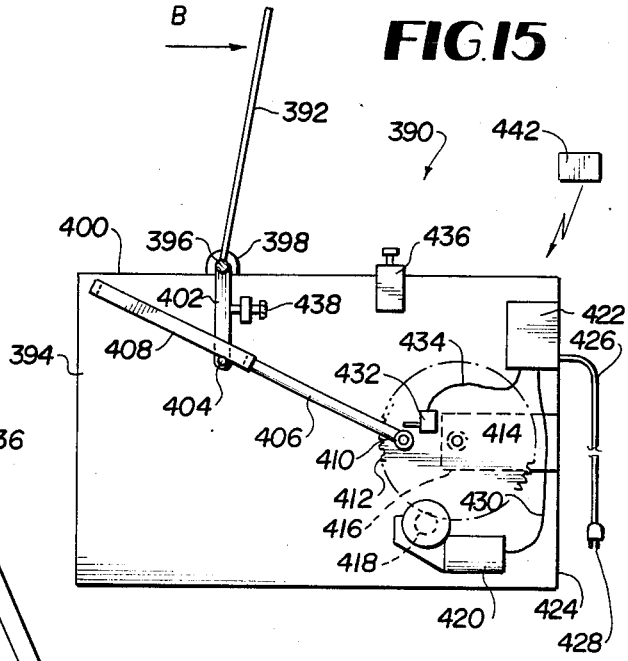
FIG. 15 is a fragmentary cross-section of another embodiment of the invention having an electric motor and illustrating a remote control radio transmitter.
Figure 16:
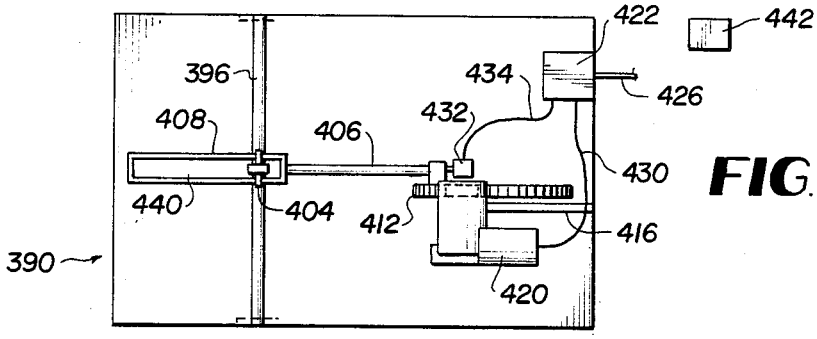
FIG. 16 is a bottom view of the embodiment of FIG. 15 with the base omitted.

Another target apparatus 390 according to the invention for facilitating the resetting of targets is shown in FIGS. 15 and 16. A single metal silhouette target 392 is pivotally mounted on a base housing 394 by means of a shaft 396 journalled at its ends in upstanding lugs 398 at the sides of the top 400 of the housing 394. An arm 402 extends downwardly from the target 392 and has a removable cross pin 404 through the lower end thereof in a direction parallel to the shaft 396. A connecting rod 406 has a slotted link 408 at the upper end thereof, the lower end of the target arm 402 engaging through the slotted link 408, the latter being retained on the arm 402 by the cross pin 404. The lower end of the connecting rod 406 is pivotally connected to a crank 410 on one side of a gear wheel 412 rotatably mounted by a stub shaft 414 on a bracket 416 rigidly secured to the housing 394. The gear wheel 412 meshes with and is driven by the output gear 418 of a gearhead electric motor 420 mounted above the base of the housing 394. A radio receiver 422 is mounted near the top of the rear wall 424 of the housing 394 and has a short power cord 426 extending through the rear wall 424 and terminating in a three pin plug 428 for detachably connecting to an AC mains supply. The motor supply lead 430 is connected to the radio receiver 422 which contains receiving and amplification circuitry and a relay operated switch for connecting the motor 420 to the AC mains supply. A micro-switch 432 is located on the bracket 416 to be actuated by passing of the crank 410. A control lead 434 connects the micro-switch to the radio receiver 422. A shock absorber 436 mounted in the top 400 cushions the fall of the target 392 when hit by a bullet travelling in the direction B. The shock absorber also functions as a stop determining the down position of the target. Another adjustable stop 438 supported from the housing 394 determines the upright position of the target, which in this embodiment is preferably at a very small angle forward of the vertical position towards the on coming bullets for stability.

In operation, when the target 392 is in the upstanding position as in FIG. 15, the connecting rod 406 is fully extended upwardly and forwardly with the lower end of the target arm 402 engaged against the lower and rearward end of the slot 440 in the slotted link 408. Upon a bullet travelling in the direction B striking the target 392, the target falls rearwardly until stopped by the shock absorber 436. During the rearward pivoting motion of the target 392, the arm 402 slides freely forward in the slot 440 which is long enough to prevent any hindrance to the falling target. To reset the target 392, a remote control transmitter 442 is actuated, its signal being received by the radio receiver 422 to connect the motor 420 to the AC mains supply and start the motor 420. The motor rotates the gear 412 so causing the connecting rod to move to the right in FIG. 15 and, with the left hand end of the slot 440 contacting the arm 402, commence raising the target 392. The motor 420 continues rotating the gear 412 until the gear has completed one full revolution, whereupon the crank 410 trips the micro-switch 432 and stops the motor 420. The target 392 will have been returned to its upstanding set position after the gear 412 has rotated 180 degrees. The rotation of the gear 412 through the next 180 degrees, to complete the revolution, slides the slotted link 408 past the arm 402 until the arm 402 has returned to the position of FIG. 15 and the target apparatus 390 is reset. In FIG. 15 only a fragment of the gear 412 is shown.

The target apparatus 390 can be modified to incorporate features of other embodiments previously described. For example, a tension spring 36 as in FIG. 1 could be incorporated, as could a target counter weight as employed in the embodiment of FIG. 1. Further, the activator switch 146 in FIG. 5 could be incorporated together with a timer to effect automatic energisation of he motor 420 after an adjustably set predetermined time.

The electrical and pneumatic operating circuits for the above described embodiments have not been shown or described in great detail as such operating and control circuitry and the components thereof are well known per se. For example, the transmitter 442, radio receiver 422 and micro-switch 432 can be constructed and connected similarly to the corresponding items in automatic garage door opening systems. The timing circuits in the timing devices 140 and 320 can be similar to those used to automatically switch off the lights in illuminated energy systems for automobiles, or to maintain the fan in a furnace system operating for a period of time after the thermostat has turned off the heater.

It will be appreciated that one or more features of any of the above described embodiments may be incorporated in any of the other embodiments as appropriate to provide automatically operated target apparatuses that are more appropriate for different kinds of target shooting and different indoor or outdoor conditions. Further, features from one or more of the illustrated embodiments may be used to replace one or more features in any of the other embodiments, for example when it is necessary to change from pneumatic power to electrical power and vice versa. Further, it may be desired to modify an embodiment to use hydraulically operated mechanism powered by an electric motor.

For example, the common reset feature of FIGS. 9 and 11 could be used to reset simultaneously a plurality of target apparatuses as shown in FIGS. 1, 2 and 3 combined in a common housing, the targets 24 being mounted individually on a common shaft, each with its own tension spring 36 etc. The common reset shaft 254 would be operated by a single air cylinder.

The target apparatus of FIGS. 6 and 7 could have only a single target 158, which could be a large silhouette target. The support structure could be modified to enable the housing 168 to rest directly on the ground and house the compressed air tank.

The reset feature of FIG. 12 based on a preselected number of hit targets could be used with a plurality of the target apparatus of FIGS. 15 and 16, or with any combination of the target apparatuses described.

As another example, the target apparatus of FIGS. 15 and 16 could be modified as previously indicated to incorporate features of FIG. 5 to reduce the power consumed by the motor 420 in resetting the target 392. Then, the motor 420 could be a universal motor or replaced by a D.C. drive and operated by a battery, such as that in FIG. 5, to render the modified target apparatus completely self-contained and automatic.

As will be appreciated, some of the features of the invention reduce the power required to reset the targets, and enable self-contained automatic target apparatuses to be provided that can operate for hours from a bottle of compressed air or a battery such as a 12 volt automobile battery. These power sources are both readily rechargeable and replaceable.

Also, the present invention provides unique versatility in the manner of resetting targets; the resetting can be arranged to occur quickly, or after a longer period, or after different periods for each target, or only when all or some predetermined number of targets have been knocked down.

The above described embodiments, of course, are not to be construed as limiting the breadth of the present invention. Modifications, and other alternative constructions, will be apparent which are within the spirit of the invention and scope of the appended claims.

What is claimed is:

1. A target apparatus for shooting ranges and the like comprising:

a support structure;

a heavy metal target pivotally mounted on said support structure;

resilient means, operative between the support structure and the target, for urging the target towards an upstanding position; and said target being yieldably retained by said resilient means in said upstanding position and being caused to start to pivot therefrom towards a down position upon impact of a bullet thereupon, said target thereafter falling to said down position under the influence of its own weight and simultaneously further loading said resilient means, whereby said resilient means experiences maximum loading in the down position of said target.

2. The target apparatus of claim 1, further comprising power means for commencing raising of said metal target from said down position to said upstanding position, the action of said power means being supplemented by said resilient means.

3. The target apparatus of claim 2, including a source of power for said power means, said source of power being caused in said support structure.

4. The target apparatus of claim 3, wherein said power means comprises an air cylinder and said source of power comprises a container of compressed air.

5. A target apparatus for shooting ranges and the like comprising:

a support structure;

a heavy metal target pivotally mounted on said support structure;

resilient means, operative between the support structure and the target, for urging the target towards an upstanding position;

power means for commencing raising of said metal target from said down position to said upstanding position, the action of said power means being supplemented by said resilient means;

means for removing the supply of power to said power means when said target has been partially raised from said down position, said resilient means completing the return of said target to said upstanding position, and said target being yieldably retained by said resilient means in said upstanding position and being caused to start to pivot therefrom towards a down position upon impact of a bullet thereupon, said target thereafter falling to said down position under the influence of its own weight and simultaneously further loading said resilient means, whereby said resilient means experiences maximum loading in the down position of said target.

6. The target apparatus of claim 5, comprising a counterweight connected to said target.

7. The target apparatus of claim 6, wherein said counterweight is heavier than said target.

8. The target apparatus of claim 5, wherein:

said resilient means comprises a spring and said power means comprises an air cylinder, and further comprising:

two levers operatively connected to said target, said spring being connected to one of said levers and said air cylinder being pivotally connected to the other, said levers being angularly spaced apart with respect to the pivotal axis to said target, and said resilient means passing "over center" from one side of said axis to the other during pivoting of said target between said upstanding and down positions.

9. A target apparatus for shooting ranges and the like, comprising:

a support structure;

a target pivotally mount on said support structure and pivotal from an upstanding position to a down position when hit by a bullet;

power means, connected to said support structure, for raising said target from said down position;

activator means, positioned for contact with the falling target from said upstanding position to said position, for activating said power means to raise said target, means for delaying the activation of said power means for a predetermined period of time after operation of said activator means by falling of said target, whereby said target is reset a predetermined period after being hit, and an adjustable stop on said support structure, and a spring operatively connected between said target and said support structure for yieldably retaining the target in said upstanding position against said adjustable stop, said spring being continuously loaded by the weight of said target during pivoting of the latter from said upstanding position to said down position.

10. A target apparatus, comprising:

a support structure having a front guard plate;

one or more targets pivotally mounted on said support structure rearwardly of said front guard plate and pivotal from an upstanding position to a down position when hit by a bullet;

power means, associated with said support structure, for resetting the one or more targets when hit, said power means including resilient means;

means, coupling said power means to said one or more targets, for raising said one or more targets from a down position;

means for uncoupling said power means from said one or more targets when said one or more targets is raised a predetermined amount less than its upstanding upstanding position, said resilient means completing the return of said one or more targets to said upstanding position; and said front guard plate protecting said resetting means from bullets being fired at said one or more targets, and being inclined forwardly and upwardly to deflect downwardly on to the ground bullets that strike said front guard plate.

11. The target apparatus of claim 10, further comprising a top plate forming part of said support structure and being disposed between said front guard plate and said one or more targets, said front guard plate extending upward above said top plate to form a lip along the front edge of said top plate to assist in retaining on said top plate bullets that hit said one or more targets and are deflected downwards and forwards onto said top plate.

12. The target apparatus of claim 10, wherein said one or more targets are heavy metal targets each having as paid resilient means a spring operative therebetween and said support structure for urging that target towards said upstanding position, said one or more targets each being yieldably retained by its spring in said upstanding position and further loading its spring under the action of its weight as it falls to said down position, the maximum loading of the or each spring occurring when the associated target reaches said down position.

13. The target apparatus of claim 10, said raising means further comprising an activator switch associated with the or each target and triggered by the falling thereof when hit to activate said resetting means, and timing means associated with said activator switch for delaying for a predetermined time the resetting of a hit target.

* * * * *